US006032112A

United States Patent [19]

Onishi et al.

[11] Patent Number: 6,032,112

[45] **Date of Patent: *Feb. 29, 2000**

[54] VOICE DATA PROCESSING DEVICE

[75] Inventors: Takafumi Onishi; Yuji Daijo, both of Hachioji, Japan

[73] Assignee: Olympus Optical Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/743,272

[22] Filed: Nov. 4, 1996

[30] Foreign Application Priority Data

Nov. 9, 1995 [JP] Japan ..... 7-291342

[51] Int. Cl.[7] ..... G10L 9/18

[52] U.S. Cl. ..... 704/201; 455/556; 379/67.1; 704/278

[58] Field of Search ..... 455/558, 556, 455/557, 418; 704/201, 278; 379/67.1, 69

[56] References Cited

U.S. PATENT DOCUMENTS

| | | | |
|---|---|---|---|
| 5,333,177 | 7/1994 | Braitberg et al. | 455/557 |
| 5,400,389 | 3/1995 | Niiyama et al. | 455/418 |
| 5,418,837 | 5/1995 | Johansson et al. | 455/558 |
| 5,444,664 | 8/1995 | Kuroda et al. | 365/226 |
| 5,559,962 | 9/1996 | Okamura et al. | 704/200 |
| 5,564,032 | 10/1996 | Aota et al. | 395/182.03 X |
| 5,678,197 | 10/1997 | Grube et al. | 455/33.1 |
| 5,680,504 | 10/1997 | Kopp | 704/201 |
| 5,692,199 | 11/1997 | Kikinis et al. | 395/733 |

*Primary Examiner*—David R. Hudspeth
*Assistant Examiner*—Daniel Abebe
*Attorney, Agent, or Firm*—Kenyon & Kenyon

[57] ABSTRACT

A voice data processing device for at least one of recording and reproducing a voice comprises a digital signal processor; a rewritable program memory, integrated with the digital signal processor, for storing a program; and a receiver, such as an earphone jack, for receiving a program rewrite signal to rewrite the program without exposing the program memory.

29 Claims, 12 Drawing Sheets

VOICE DATA PROCESSING DEVICE

BACKGROUND OF THE INVENTION

1. Field of the Invention

The present invention relates to a voice data processing device, particularly to a voice data processing device for at least one of recording and/or reproducing a voice.

2. Description of the Related Art

Recently, a digital voice recording and/or reproducing device (hereinafter called simply "digital voice recorder") for recording and/or reproducing a voice has been developed. When a voice is recorded, the digital voice recorder collects the voice as an analog signal by a microphone or the like. The analog signal is converted to a digital signal which is then stored in a storage medium, for example, an IC memory. When the recorded voice is reproduced, the stored digital voice signal is read out from the storage medium, converted to an analog signal, which is then reproduced as a voice by a speaker or the like. Japanese Laid-Open Patent Application Publication No. Sho 63-259700 discloses a digital voice recorder as described above.

A voice data processing device as the digital voice recorder generally applies to the digitized voice signals a coding technique for efficiently compressing the volume of data for saving the space of the storage medium such as the IC memory.

The voice data processing device uses a digital signal processor (DSP) for highly efficient real time coding and decoding.

When the device is manufactured, a program for the highly efficient coding and decoding or the like to be executed by the digital signal processor is first written in a read only memory (ROM) which is then incorporated in the digital signal processor. However, in the voice data processing device, requirements for voice quality, maximum recording time, and functions are different in accordance with its application, and it has been necessary to produce the devices of different specifications for respective applications. Thus, it has been necessary to distinguish at the initial stage of production the devices of different specifications from each other. Accordingly, the devices have been produced after the number of devices of each type was determined. In such a production system for producing the devices differently in accordance with their specifications, a close marketing research is necessary, and even if the close marketing research is implemented, a large amount of surplus or shortage of the products may occur depending on a market trend. Moreover, the existence of various products may result in high costs for production and inventory control. As a result, the product costs may often be increased.

The program of the digital signal processor in the conventional voice data processing device cannot be written and/or rewritten to change its specifications. Therefore, when a new product having new specifications for voice quality, maximum recording time, functions or the like is introduced to the market, users of the old device have to buy a new one, if they desire the new specifications. It is a problem for users to spend extra expense for updating the product.

SUMMARY OF THE INVENTION

It is an object of the present invention to provide a voice data processing device which is useful for users and can be manufactured efficiently, and low cost.

According to the present invention, a voice data processing device for at least one of recording and reproducing a voice comprises a digital signal processor; a rewritable program memory, integrated with the digital signal processor, for storing a program; and a receiver for receiving a program rewrite signal to rewrite the program without exposing the program memory.

DETAILED DESCRIPTION OF THE PREFERRED EMBODIMENTS

With reference to the accompanying drawings, the preferred embodiments of the present invention will now be described.

Figure 1:
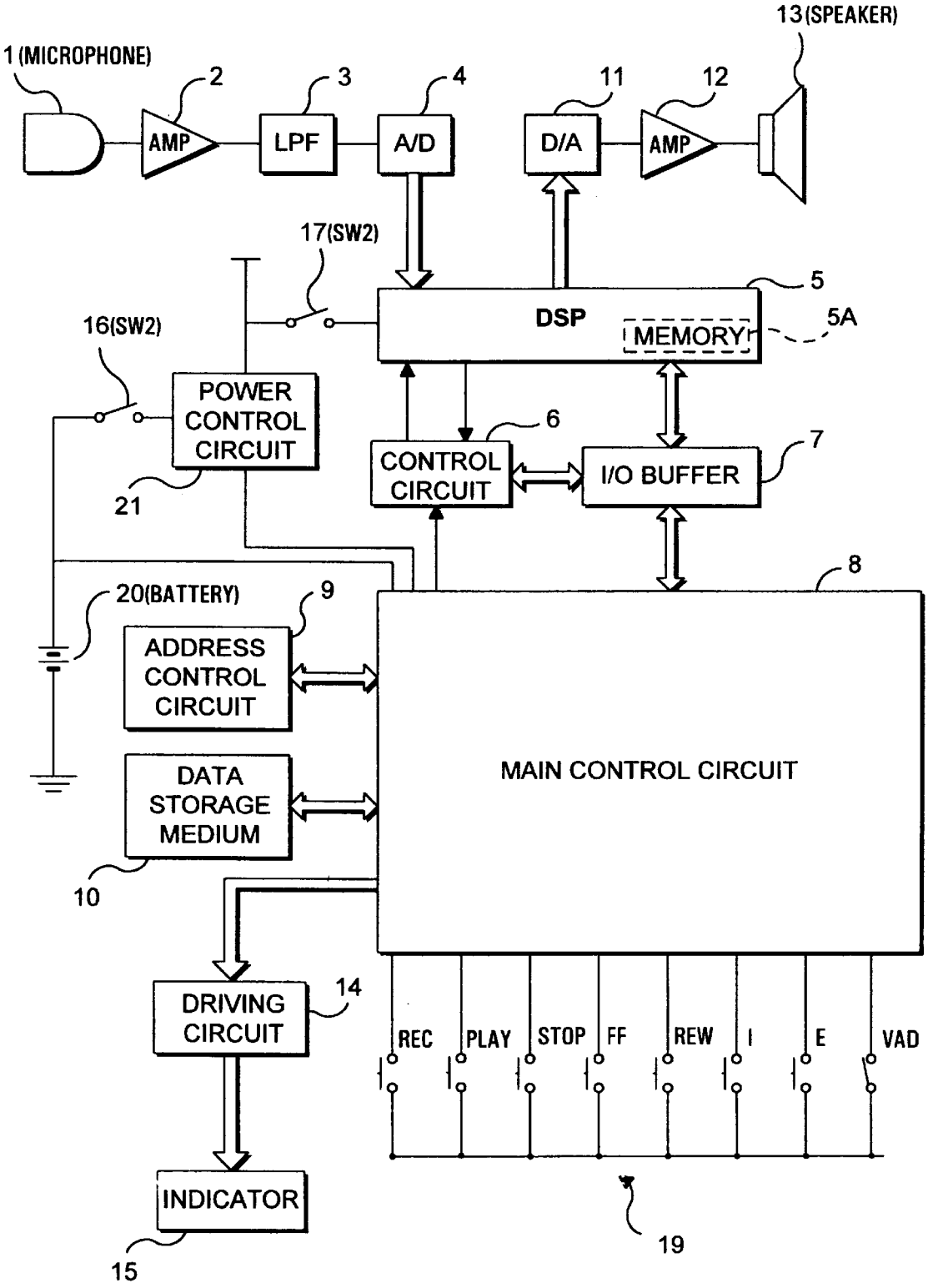
FIG. 1 is a block diagram which shows a structure of a voice data processing device in a first embodiment of the present invention.

FIG. 1 is a block diagram which shows a structure of a voice data processing device in a first embodiment of the present invention.

As shown in FIG. 1, the voice data processing device in the first embodiment comprises a microphone 1 for converting a voice to an electric signal. The voice signal outputted from the microphone 1 is amplified by a pre-amplifier 2, which is connected to the microphone 1. This output of the pre-amplifier 2 is inputted to an analog-to-digital converter (hereinafter called simply "A/D converter") 4 through a low-pass filter 3. An unnecessary frequency band of the analog voice signal amplified by the amplifier 2 is cut off by the low-pass filter 3 to prevent aliasing noises and the resultant signal is inputted to the A/D converter 4.

In the A/D converter 4, the analog voice signal is converted to a digital signal, which is then inputted to a DSP 5 as means for processing a digital signal.

The digital signal processor is coupled to a control circuit 6 as a central processing unit (CPU) for controlling operations of the DSP 5, as well as to an input-output buffer (hereinafter called simply "I/O buffer") 7 as buffer means for temporarily storing coded data. The control circuit 6 is coupled to a main control circuit 8 descried below, and is controlled thereby.

The DSP 5 integrates (includes or externally couples to) an electrically rewritable program memory 5A. Writing into the memory 5A is implemented by a predetermined signal to be transmitted from a below-mentioned receiver for receiving a program write signal. This program writing operation is described below.

A battery (BAT) 20 for supplying electric power to the whole voice data processing device supplies an operating voltage to the digital signal processor 5 through a main power switch 16 (SW1), a power control circuit 21 and a DSP power switch 17 (SW2). The ON/OFF operation of the DSP power switch 17 is controlled by the main control circuit 8 through the power control circuit 21. The battery 20 is a power supply battery incorporated in the voice data processing device, and supplies electric power to the main control circuit 8 when the battery 20 is loaded. The main power switch 16 is coupled to the anode of the battery 20. The main power switch 16 is the switch for supplying electric power to the whole voice data processing device. The ON/OFF operation of the main power switch 16 is detected by the main control circuit 8.

Although not shown in the figure, the power supply control circuit 21 supplies electric power from the battery 20 to each circuit of the voice data processing under the control of the main control circuit 8 when the main power switch 16 is turned on.

At the time of recording, the digital signal processor 5 is controlled by the control circuit 6 so that the voice signal converted to the digital signal by the A/D converter 4 is compressively transformed (coded) to data in a predetermined format. The coded data is temporally stored in the I/O buffer 7, and then transmitted to the main control circuit 8. At the time of reproduction, the digital signal processor 5 is controlled by the control circuit 6 to decompressively transform (decode) the data from the main control circuit 8, and the decoded digital signal is inputted to a digital-to analog converter (hereinafter called "D/A converter") 11. The voice signal converted to an analog signal by the D/A converter 11 is inputted to a power amplifier 12 which amplifies the voice signal and drives a speaker 13, through a low-pass filter (not shown) which cuts off an unnecessary frequency band of the voice signal and reduces quantized noises. The voice signal amplified by the power amplifier 12 is reproduced as a voice by the speaker 13.

The main control circuit 8 comprises a microprocessor as a central processing unit (CPU) and serves as control means for controlling the electric power supply to the digital signal processor, and the operations of respective portions of the voice data processing device. In accordance with the operation of an operating portion 19 having a plurality of operation buttons and switches, the main control circuit 8 controls the operation of an address control circuit 9 coupled to the main control circuit 8 and a data storage medium 10 removably attached to the voice data processing device.

As described above, the main control circuit 8 starts its operation upon loading of the battery 20 and detects the ON/OFF operation of the main power switch 16. The main control circuit 8 also controls through the power control circuit 21 the power control circuit 21 the power supply to each circuit.

The I/O buffer 7 is also coupled to the main control circuit 8 as explained above. The data outputted from the digital signal processor 5 is transmitted to the main control circuit 8 through the I/O buffer 7.

As mentioned above, the data storage medium 10 and the address control circuit 9 are coupled to the main control circuit 8. The main control circuit 8 transmits an appropriate address signal in accordance with the operation of the operating portion 19, stores the data from the I/O buffer 7 in the data storage medium 10, and transmits the data read from the data storage medium 10 to the DSP 5 through the I/O buffer 7.

The data storage medium 10 is an IC memory, and comprises a temporary storage medium and a main storage medium. For example, a static random access memory (SRAM), an electric erasable programmable read only memory (EEPROM), a high dielectric memory, a flash memory or the like are adopted as the temporary storage medium. Compared with the data main storage medium, the temporary storage medium can read and write data at a relatively high speed. On the other hand, for example, a flash memory, a magneto-optical disc, a magnetic disc, a magnetic tape or the like are adopted as the main storage medium. In the first embodiment of the present invention, an SRAM is adopted as the temporary storage medium, and a flash memory is adopted as the main storage medium.

An address as the information representing the storage position of a voice data may be stored in the data storage medium 10 as the removable IC memory, or in an incorporated storage medium as an IC memory (not shown) associated with the address control circuit 9 incorporated in the voice recording and/or reproducing device.

Further, the main control circuit 8 is coupled to the operating portion 19 as an operation means for selecting operating modes of the voice data processing, and through a driving circuit 14 to an indicator 15 for indicating the operating modes, the recording time or the like.

Figure 11:
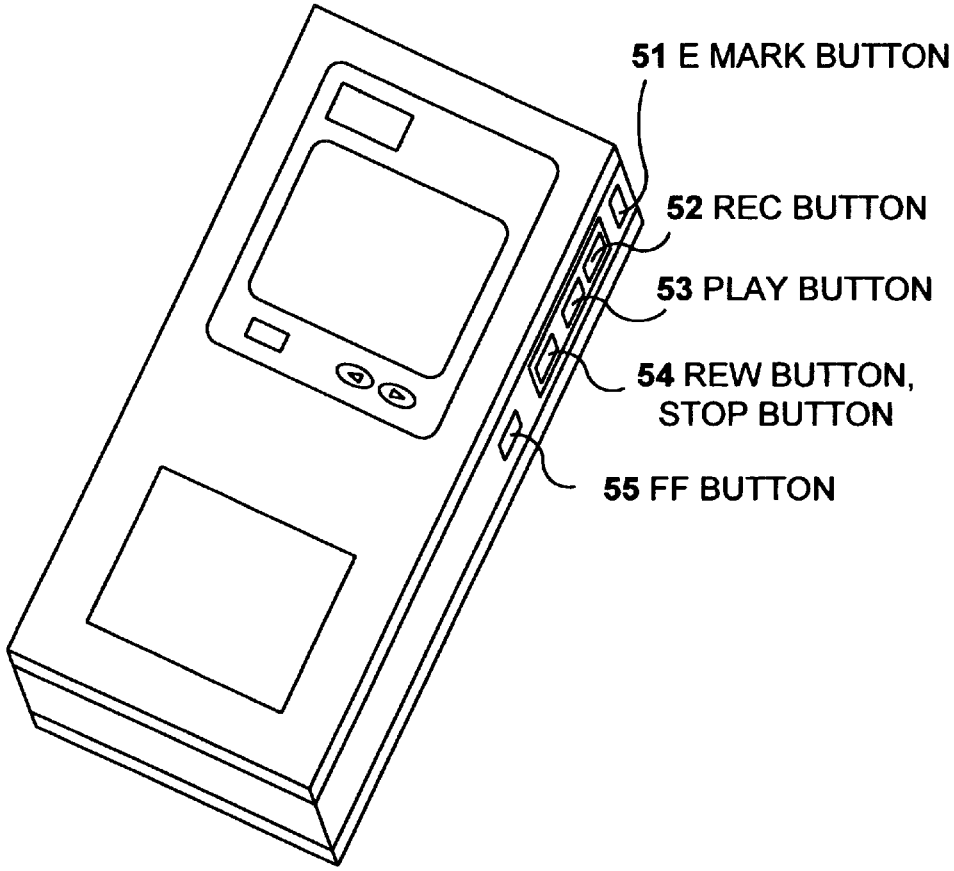
FIG. 11 is a perspective view of the voice data processing device in the first embodiment of the present invention.

FIG. 11 is a perspective view of the voice data processing device in the first embodiment of the present invention.

As shown in FIG. 11, the operating portion 19 includes a recording button (REC button) 52, a reproducing button (PLAY button) 53, a stop button 54, a button for changing reproduced position by skipping forward (FF button) 55, a button for changing reproduced position by skipping backward (REW button) 54, an I mark button (not shown), an E mark button 51, and a voice active detector button (not shown).

Both the I mark button and the E mark button 51 will be described.

Since a plurality of data files are stored in the data storage medium 10, an instruction (I) mark as an index mark for a typist or a secretary to define a priority relationship between the plurality of data files can be stored by operating the I mark button when the voice is recorded. Using the I mark, the user can indicate the priority relationship between the data files by the sound represented by the I mark.

In order to indicate the end of each data file, an end (E) mark as an index mark can be stored by operating the E mark button.

The receiver for receiving the program write signal for writing a program into the memory 5A incorporated in the digital signal processor 5 will now be described.

Figure 2:
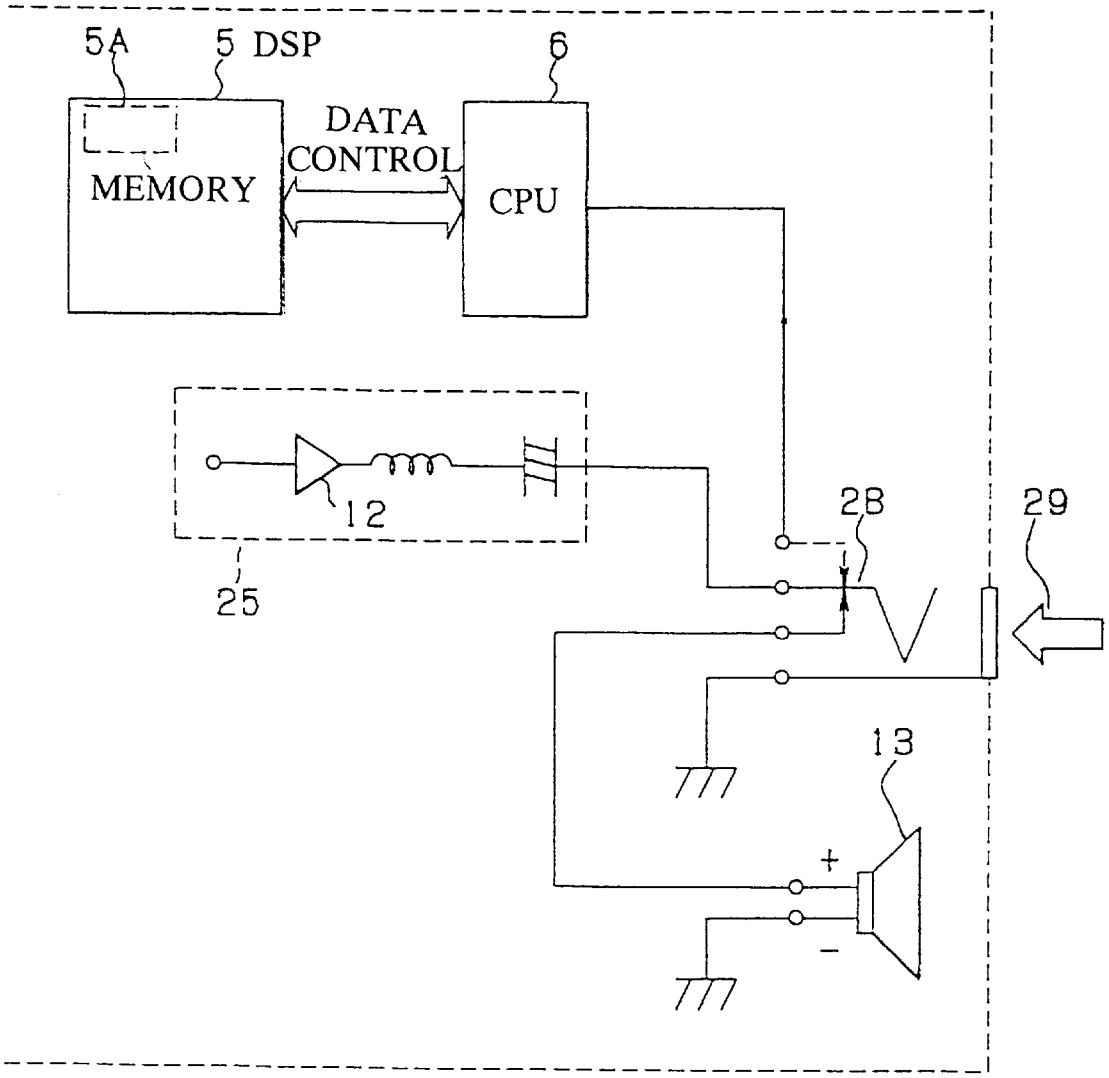
FIG. 2 is a block diagram which shows a receiver for receiving a program rewrite signal for a program memory, and its peripheral portion, in the voice data processing device of the first embodiment of the present invention.

FIG. 2 is a block diagram which shows a receiver for receiving a program rewrite signal for the program memory 5A, and its peripheral portion, in the voice data processing device of the first embodiment of the present invention. As described above, the digital signal processor 5 incorporates the memory 5A for storing at least one program to be processed in the DSP 5. In the first embodiment of the present invention, the flash memory is adopted as the program memory 5A. Besides the flash memory, an electrically rewritable memory, such as an SRAM, an EEPROM, a high dielectric memory or the like, may be adopted. Moreover, the memory 5A is not required to be incorporated in the digital signal processor 5 and may be operatively integrated with the digital signal processor 5.

Further, the control circuit 6 is coupled to the digital signal processor 5. Under the control of the control circuit 6, a predetermined DSP processing program can be written into the program memory 5A.

The control circuit 6 can be coupled to a connector 28 as the receiver for receiving the program rewrite signal, which is provided in a casing of the voice data processing device so as to be exposed to the outside. The connector 28 has not only the function as the receiver for receiving the rewrite signal, but also the other functions. In the first embodiment of the present invention, an earphone jack is adopted as the connector 28. The earphone jack 28 is a voice output terminal, and coupled to an amplifying and outputting portion 25 including the power amplifier 12. When an earphone plug (not shown) is inserted into the earphone jack 28, the earphone jack 28 acts as a conventional voice output terminal, and reproduces the voice based on the signal transmitted from the amplifying and outputting portion 25 (See FIG. 13). In addition to the earphone jack 28, the speaker 13 is coupled to the amplifying and outputting portion 25. When the earphone plug is inserted into the earphone jack 28, the speaker 13 is disconnected.

In the first embodiment of the present invention, an output plug 29 of an external, program rewriting device (not shown) for transmitting program data to the program memory 5A can be inserted into the earphone jack 28. The voice data processing device is capable of recognizing the difference between the output plug 29 and the conventional earphone plug. When the output plug 29 is inserted into the earphone jack 28, a predetermined signal is transmitted to either the control circuit 6 or the main control circuit 8 by plug discriminating means (not shown), so that the connection of the program rewriting device can be recognized.

When the output plug 29 is inserted into the earphone jack 28, the earphone jack 28 is disconnected from the amplifying and outputting portion 25 and the speaker 13, and connected to the control circuit 6.

That is, the earphone jack 28 normally serves as the voice output terminal. However, when the program rewriting device is coupled to the earphone jack 28, the earphone jack 28 serves as the receiver for receiving the program rewrite signal for the program memory 5A.

The discriminating means may be implemented such that it recognizes the inserted plug by providing the output jack 29 and the earphone jack with different shapes. Alternatively, even if both plugs have the same shape, the discriminating means may be formed such that when the output plug 29 is inserted, a predetermined signal is transmitted from the program rewriting device through a circuit (not shown) to the control circuit 6 or the main control circuit 8 to electrically change over the connection.

Figure 12:
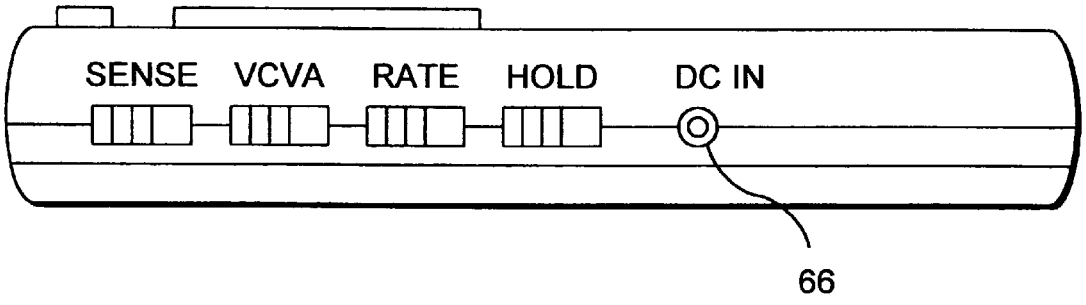
FIG. 12 is a side view of the voice data processing device in the first embodiment of the present invention.
Figure 13:
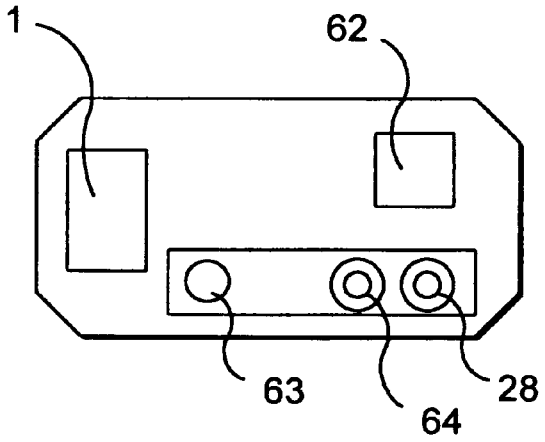
FIG. 13 is another side view of the voice data processing device in the first embodiment of the present invention.

FIG. 12 is a side view the voice data processing device in this embodiment, and FIG. 13 is another view of the voice data processing device. In this embodiment, the earphone jack 28 is adopted as the connector (see FIG. 13), but an output terminal for an external speaker, an input terminal 64 for the microphone, an input terminal (DC-IN) 66 for an external electric power source (See FIG. 12) or the like may be used for rewriting the program of the program memory 5A. In this case, naturally a coupling portion of the plug or the like has a shape corresponding to the respective terminal. FIG. 13 illustrates the incorporated microphone 1, a window 62 for emitting infrared rays and a light emitting portion 63 for emitting light during the voice recording.

Figure 14:
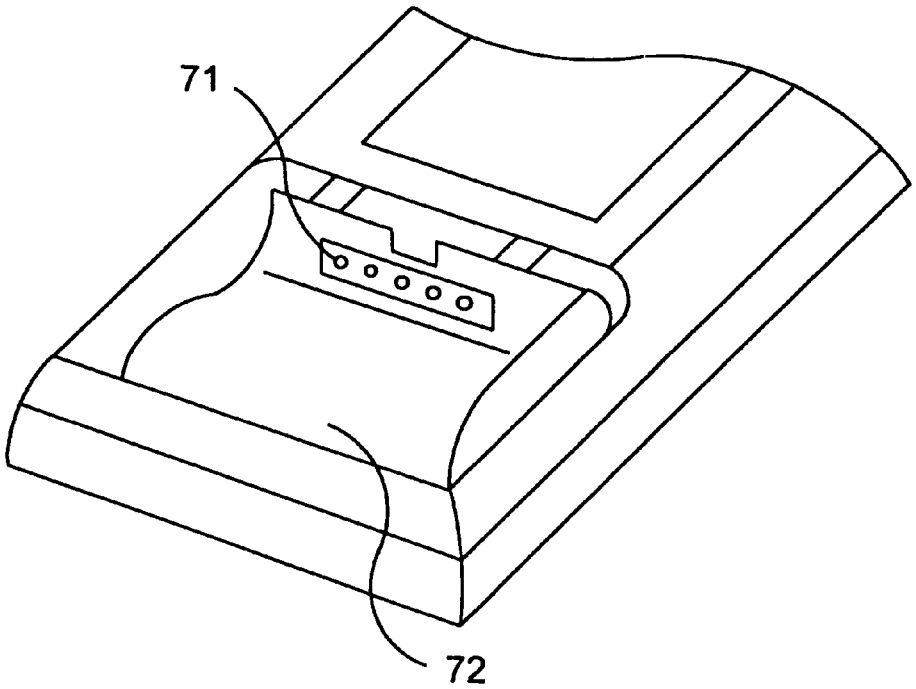
FIG. 14 is an enlarged partial perspective view of a modification of the voice data processing device in the first embodiment of the present invention.

FIG. 14 is an enlarged partial perspective view of a modification of the voice data processing device in the first embodiment of the present invention.

As shown FIG. 14, a connector 71 used only for writing the DSP program is provided in a battery chamber 72 formed in the voice data processing device. The connector 71 is coupled to the program rewriting device to transmit and receive the DSP program data so that a predetermined process may be implemented.

Figure 3:
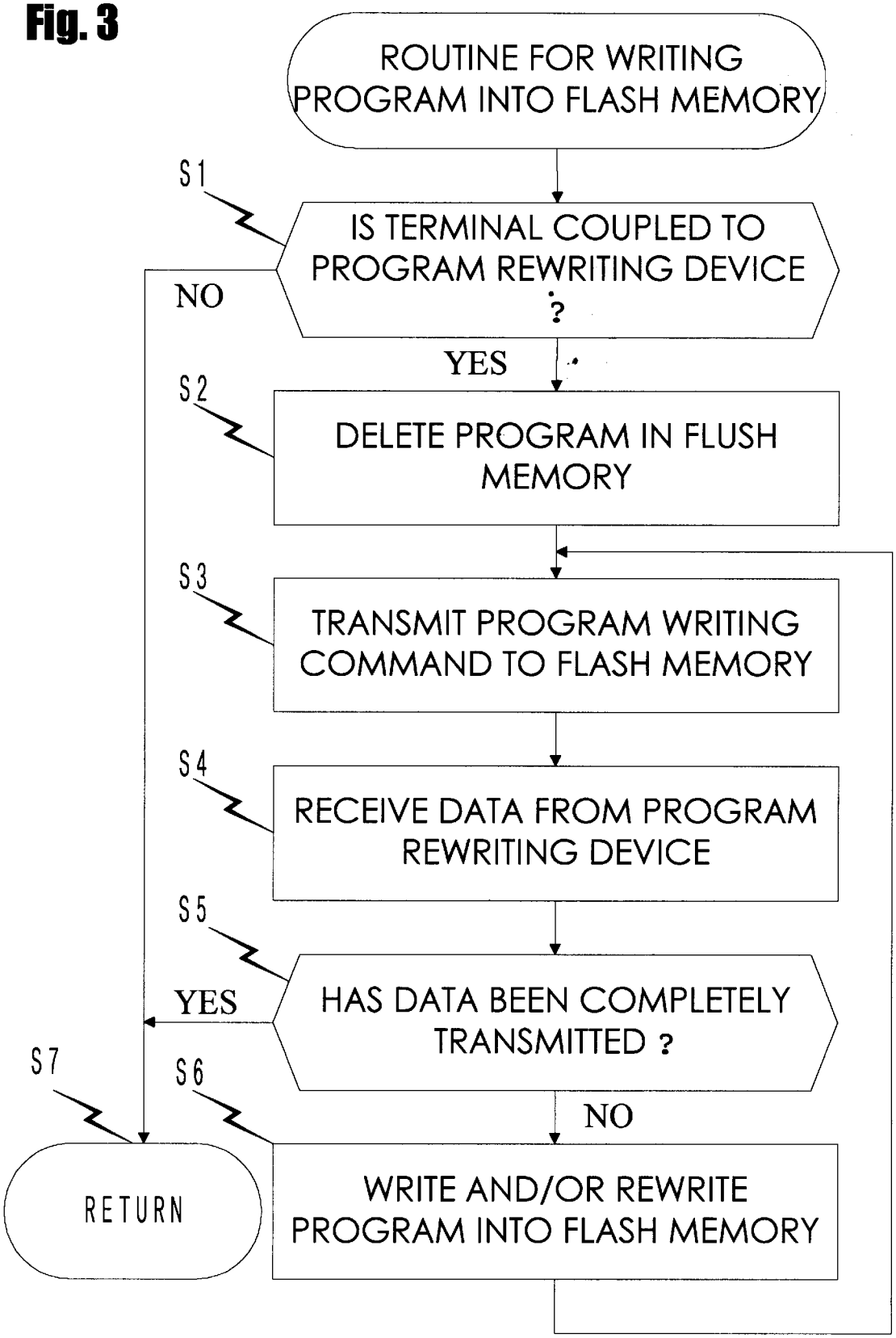
FIG. 3 is a flowchart which shows steps for writing a DSP program into the program memory in the voice data processing device in the first embodiment of the present invention.

With reference to a flowchart in FIG. 3, a process of writing the DSP program into the program memory 5A is described in detail.

When a plug such as the output plug 29 or the like is inserted into the earphone jack 28, the control circuit 6 implements writing operation for the program memory 5A (flash memory).

In step S1, based on the information from the discriminating means, the control circuit 6 determines whether the program rewriting device is coupled to the connector or not. If the device is not coupled to the connector, the process goes to step S7 and exits the routine. Otherwise the process goes to step S2.

In step S2, the program in the program memory 5A (flash memory) is deleted.

In step S3, the control circuit 6 transmits a program writing command to the memory 5A.

In step S4, the control circuit 6 receives the data transmitted from the program rewriting device.

In step S5, the control circuit 6 determines whether the data has been completely received or not. If not, the process goes to step S6, and goes back to step S3. Otherwise the process goes to step S7, and exits the routine.

In step S6, the control circuit 6 writes and/or rewrites the program into the program memory 5A.

According to the first embodiment of the present invention, when the products having different specifications for respective applications are manufactured, the specifications can be determined at the final stage so that the products can be manufactured effectively.

Next, a second embodiment of the present invention will now be described.

Figure 4:
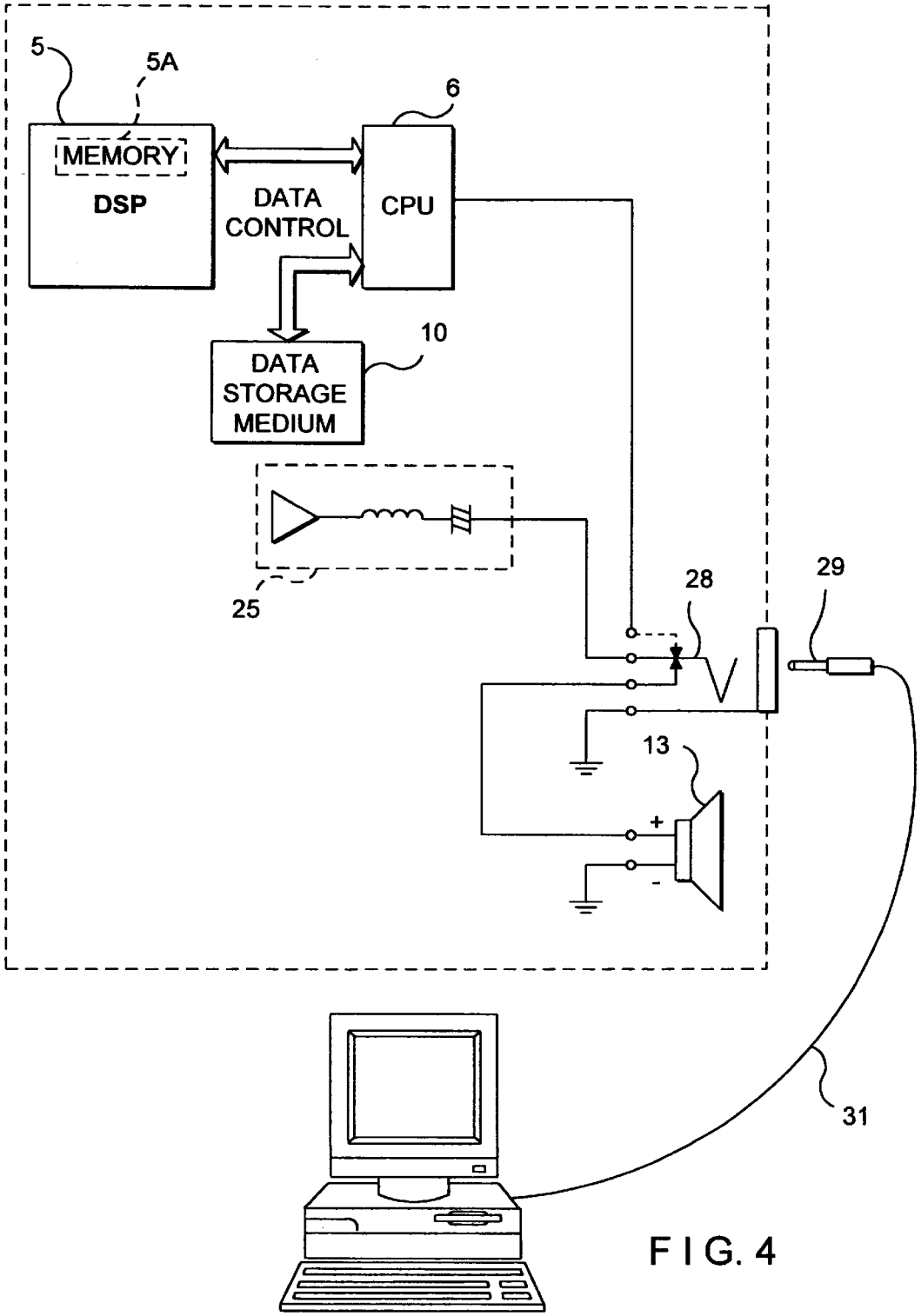
FIG. 4 is a block diagram which shows a receiver for receiving a program rewrite signal for a program memory, and its peripheral portion, in a voice data processing device in a second embodiment of the present invention.

FIG. 4 is a main block diagram which shows a receiver for receiving a program write signal for a program memory, and its peripheral portion, in a voice data processing device in the second embodiment of the present invention. The same elements as those of the first embodiment are given the same reference numerals and their details are omitted.

The voice data processing device in the second embodiment of the present invention has substantially the same structure as that of the first embodiment, but is characterized in that a personal computer is adopted as a program rewriting device. RS-232C as a conventional serial interface is adopted for a connection between the voice data processing device and the personal computer. A data storage medium 10 is coupled to a control circuit 6 via a main control circuit 8 (not shown).

In this embodiment, under the control of the control circuit 6, a digital signal processor 5 writes into the storage medium 10 for storing a voice data a DSP program transmitted from the personal computer 30 through a two-core cable 31 and reads out the written DSP program to write it into a program memory 5A in the digital signal processor 5.

Figure 7:
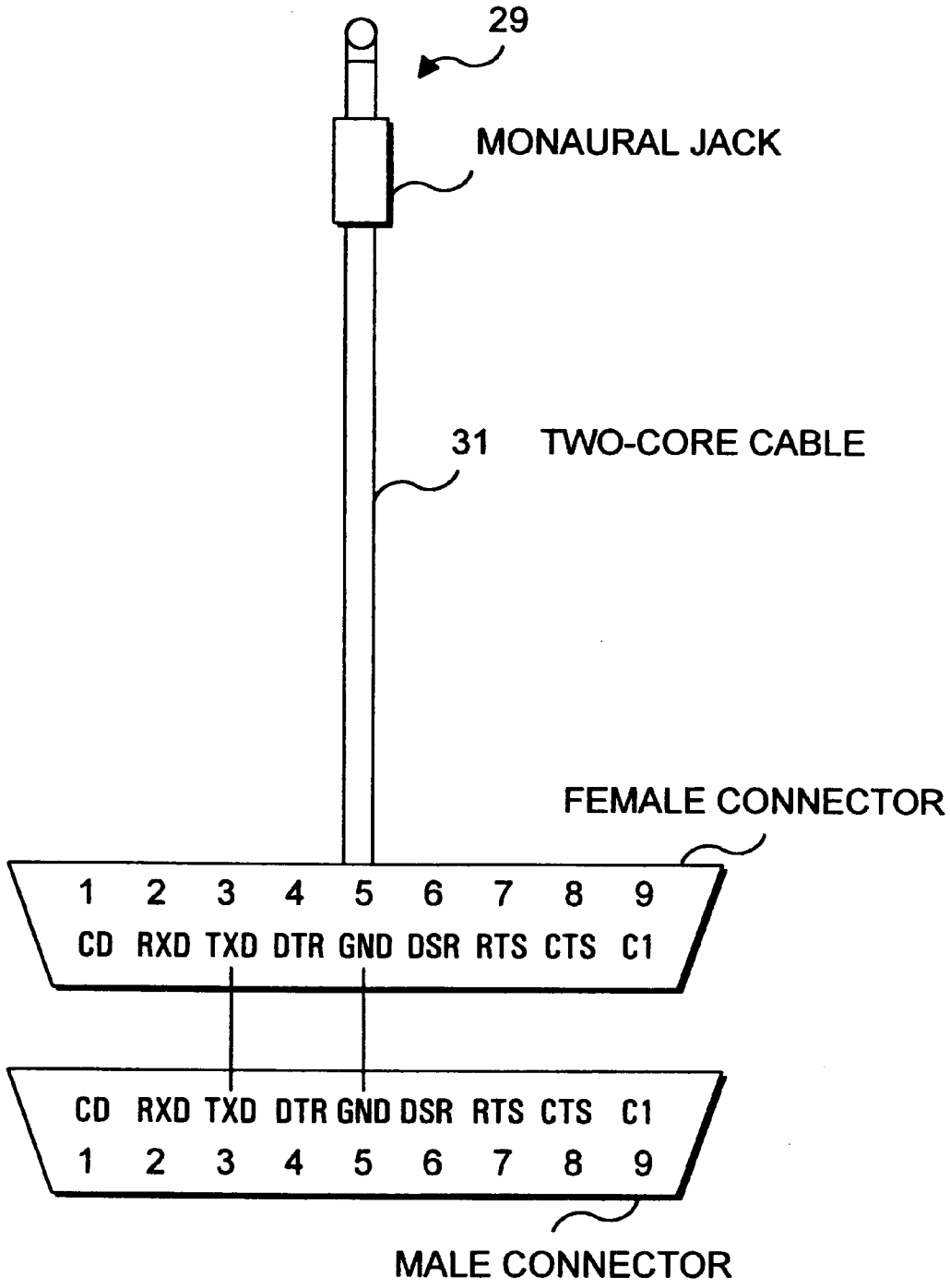
FIG. 7 is an illustration of a two-core cable and a connector for connecting the personal computer and the voice data processing device in the second embodiment of the present invention.

As shown in FIG. 7, in this embodiment, a monaural jack 29 as an output plug to be coupled to the voice data processing device is located at one end of the two-core cable 31, and a female connector (D-SUB 9 pins type) is located at the other end of the two-core cable 31 to be coupled to a male connector (D-SUB 9 pins type) located on the personal computer 30.

As described above, the RS-232C serial interface is used as a data transmitting interface. The RS-232C interface connector on the side of the personal computer 30 is connected to the two-core cable by two signal lines, TXD and GND, as shown in FIG. 7.

Figure 5:
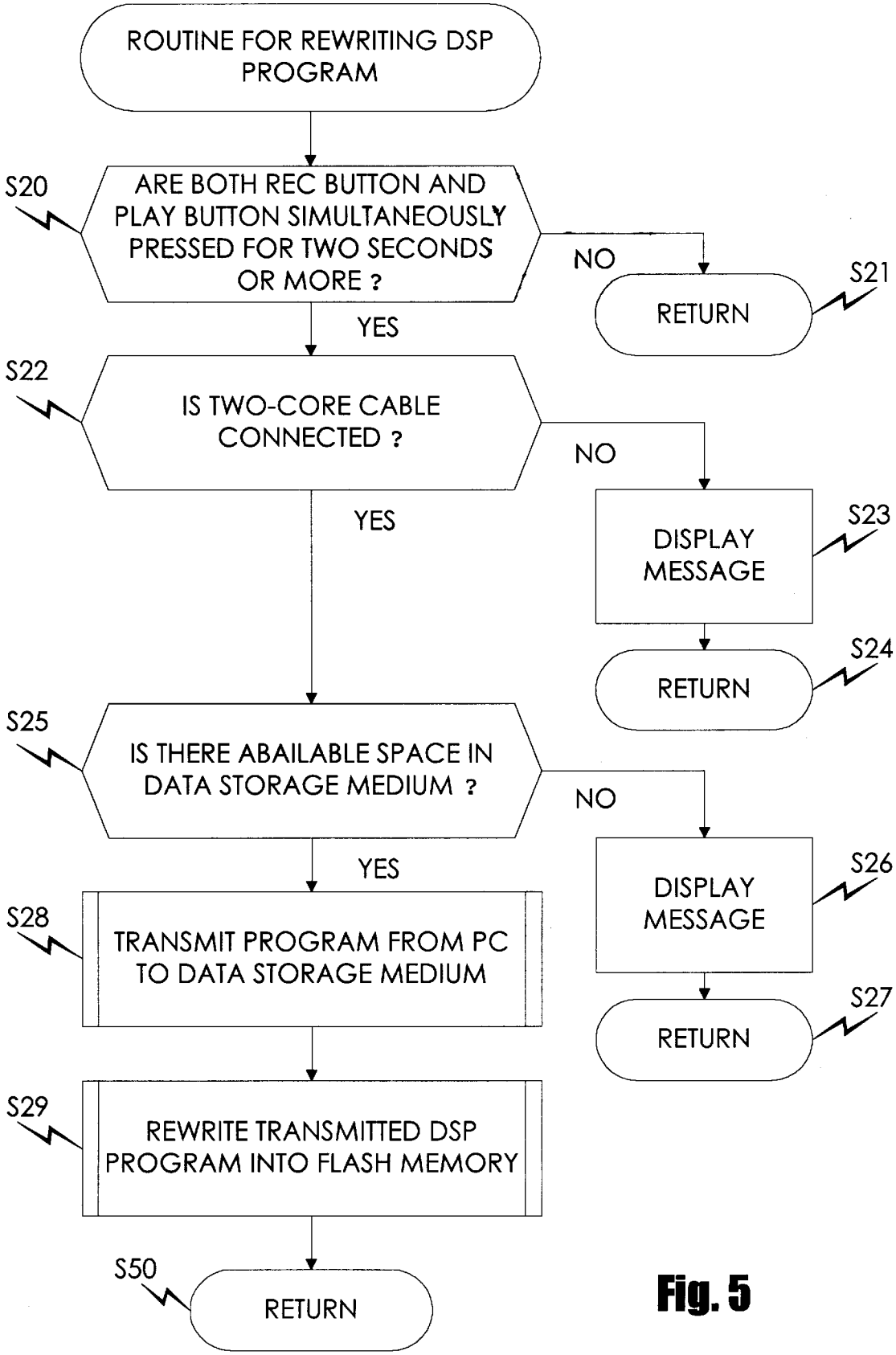
FIG. 5 is a flowchart which shows steps for rewriting a DSP program into the program memory in the voice data processing device in the second embodiment of the present invention.

With reference to a flowchart in FIG. 5, a process of writing the DSP program into the program memory 5A in the second embodiment of the present invention is described below.

In step S20, the control circuit 6 monitors whether two or more predetermined operation buttons selected from a plurality of operation buttons located on the voice data processing device have been simultaneously being pressed for a predetermined time or not. When the time for pressing the buttons is less than 2 seconds, this process goes to step S21. In this embodiment, the predetermined operation buttons are a REC button and a PLAY button, and the predetermined time is 2 seconds. When the control circuit 6 monitors that the buttons have been pressed 2 seconds or more, in step S22, the control circuits 6 detects whether the voice data processing device is connected to the personal computer 30 by the two-core cable 31 or not. If it is not connected, an indicator 15 indicates that the connection is incomplete in step S23, and this process goes to step S24. When they are connected, in step S22, the control circuit 6 proceeds to the DSP program rewriting mode.

In step S25, the control circuit 6 determines whether there is an unrecorded space of 64 Kbytes or more in the voice data storage medium 10.

If there is no such space, the control circuit 6 calculates the amount of recorded data, in terms of recording time (seconds), which should be deleted in order to secure an unrecorded space of 64 Kbytes or more, and indicates it on an indicator 15 in step S26, and exits the DSP program rewriting mode in step S27.

On the other hand, if it is determined in step S25 that there is a space of 64 Kbytes or more, the control circuit 6 decides that the DSP program can be transmitted, and indicates on the indicator 15 that the DSP program should be transmitted from the personal computer 30. In step S28, the user makes transmission starting operation from the personal computer 30 to transmit the DSP program to the voice data storage medium 10. When the transmission has been finished, the control circuit 6 reads out the DSP program transmitted to the voice data storage medium 10 and rewrites the DSP program into the program memory 5A (flash memory) in the digital signal processor 5 in step S29, and exits from the DSP program rewriting mode in step S50.

Figure 6:
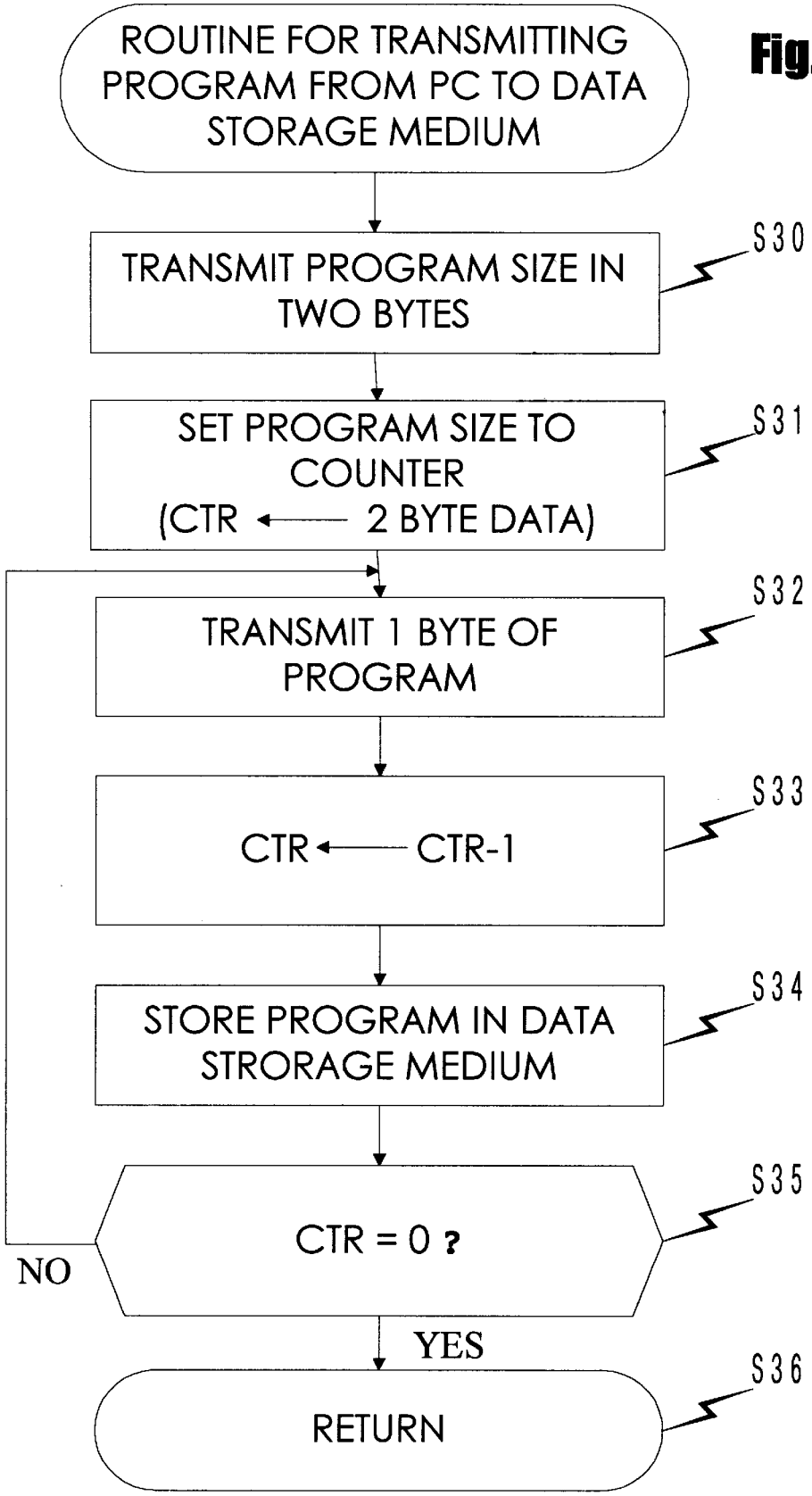
FIG. 6 is a flowchart which shows detailed steps in a routine for transmitting a DSP program from a personal computer to a voice data storage medium in the voice data processing device in the second embodiment of the present invention.

With reference to a flowchart in FIG. 6, the details of the processing routine of transmitting the DSP program from the personal computer 30 to the voice data storage medium 10 in step S28 will be described.

In step S30, the size of the DSP program to be rewritten is indicated in two bytes by the personal computer 30 and the two-byte data is transmitted to the storage medium 10 through the control circuit 6.

In step S31, the control circuit 6 sets the two-byte data to a counter (CTR).

In step S32, one byte of the DSP program to be rewritten is transmitted from the personal computer 30.

In step S33, when receiving the data, the control circuit 6 subtracts one from the number set in the counter.

In step S34, the control circuit 6 stores the received one-byte data into the voice data storage medium 10.

In step S35, the control circuit 6 determines whether the number of the counter is zero or not. If it is not zero, the control circuit 6 recognize that there are some data to be transmitted, and returns to step S32 to continue the process. If it is zero, the control circuit 6 determines that the data transmission has been finished, and exits the process in step S36.

Figure 8:
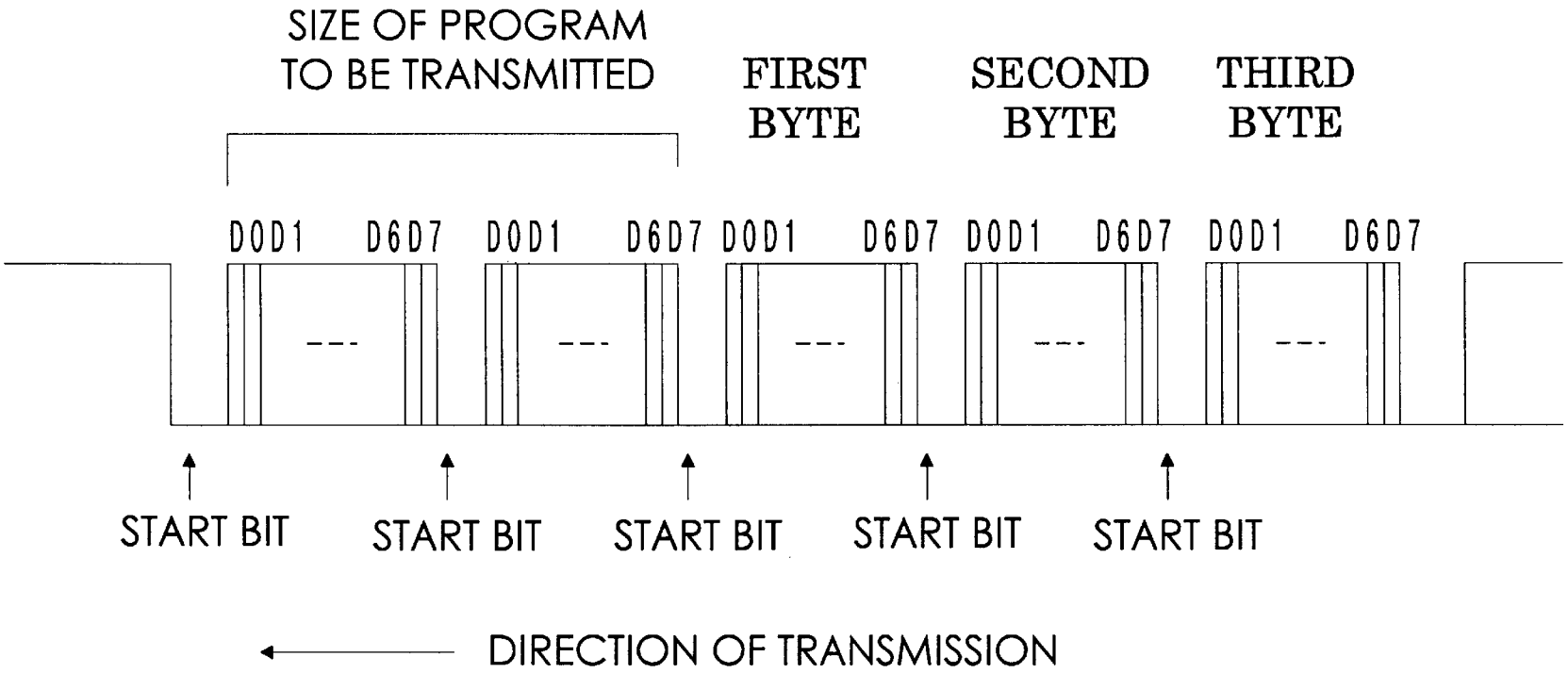
FIG. 8 is an illustration of a waveform at the time of serial data transmission in the voice data processing device in the second embodiment of the present invention.

FIG. 8 shows a waveform at the time of serial data transmission.

Figure 9:
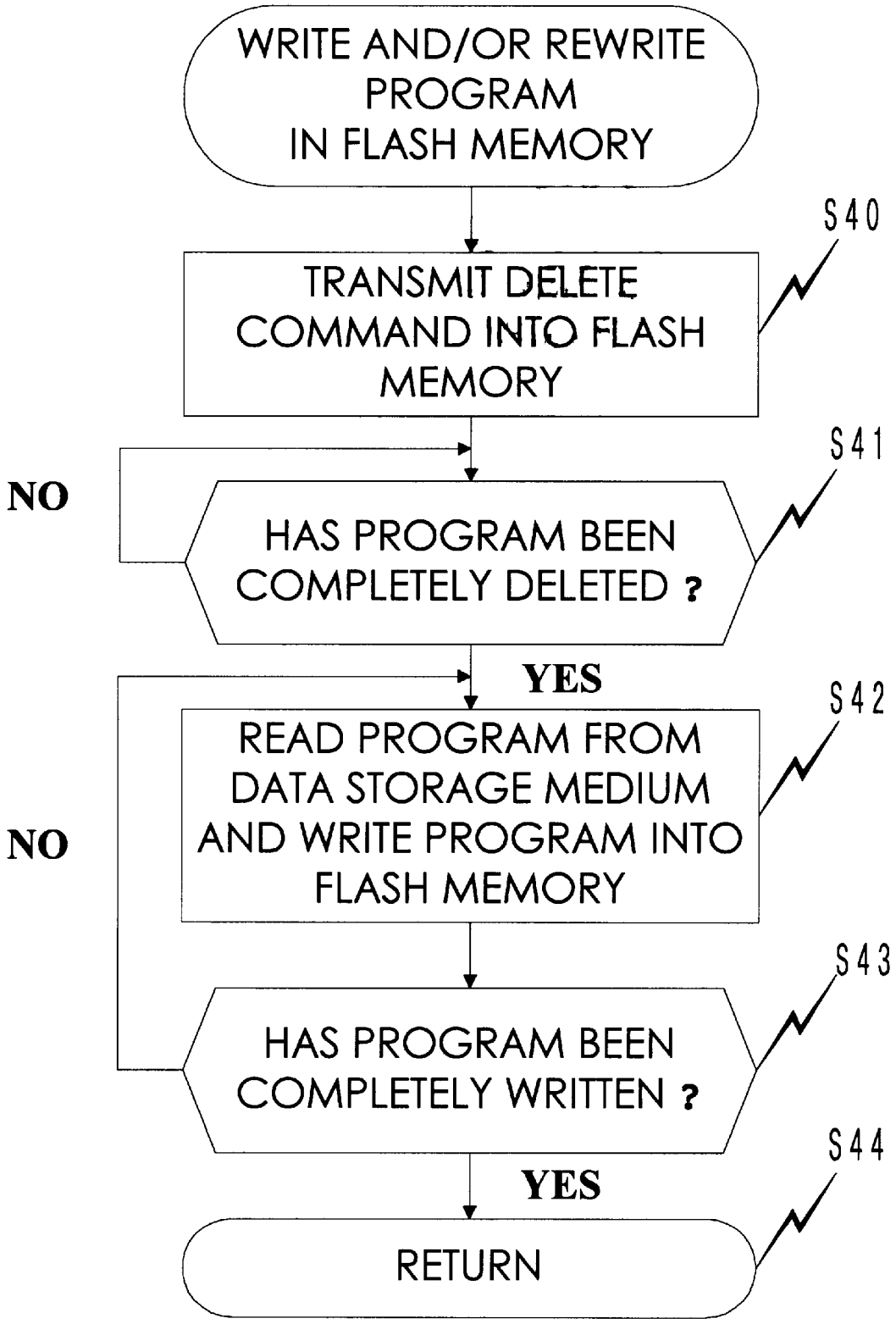
FIG. 9 is a flowchart which shows detailed steps in a routine for rewriting the DSP program transferred to the voice data storage medium, into the program memory within the digital signal processor in the voice data processing device in the second embodiment of the present invention.

With reference to a flowchart in FIG. 9, the details of the processing routine in step S29 of rewriting into the program memory 5A (flash memory) in the digital signal processor (DSP) 5 the DSP program transmitted to the storage medium 10.

In step S40, the control circuit 6 transmits a command for deleting the desired program in the program memory 5A (flash memory) in the digital signal processor (DSP) 5.

In step S41, the control circuit 6 discriminates whether the program has been deleted or not. If deleted, the process goes to step S42. Otherwise, the process waits for the completion of the deletion of the program.

In step S42, the control circuit 6 reads out from the voice data storage medium 10 the frontmost one byte of the DSP program transmitted from the personal computer 30 and writes it into the program memory 5A.

In step S43, it is determined whether the program has been completely rewritten. If so, the process exits from the routine in step S44. Otherwise, the processing loop of step S42 is repeated until the rewriting is completed.

According to the second embodiment of the present invention, even if the product (voice data processing device) has been sold to a user, the user can couple his or her personal computer to the voice data processing device to rewrite the program of the digital signal processor (DSP) by using the personal computer. Even if the user does not have the personal computer, the user can have the program rewritten at a retail store. Thus, the user does not need to buy a new product in order to update the product, thereby saving extra expense.

A third embodiment of the present embodiment will be described below.

Figure 10:
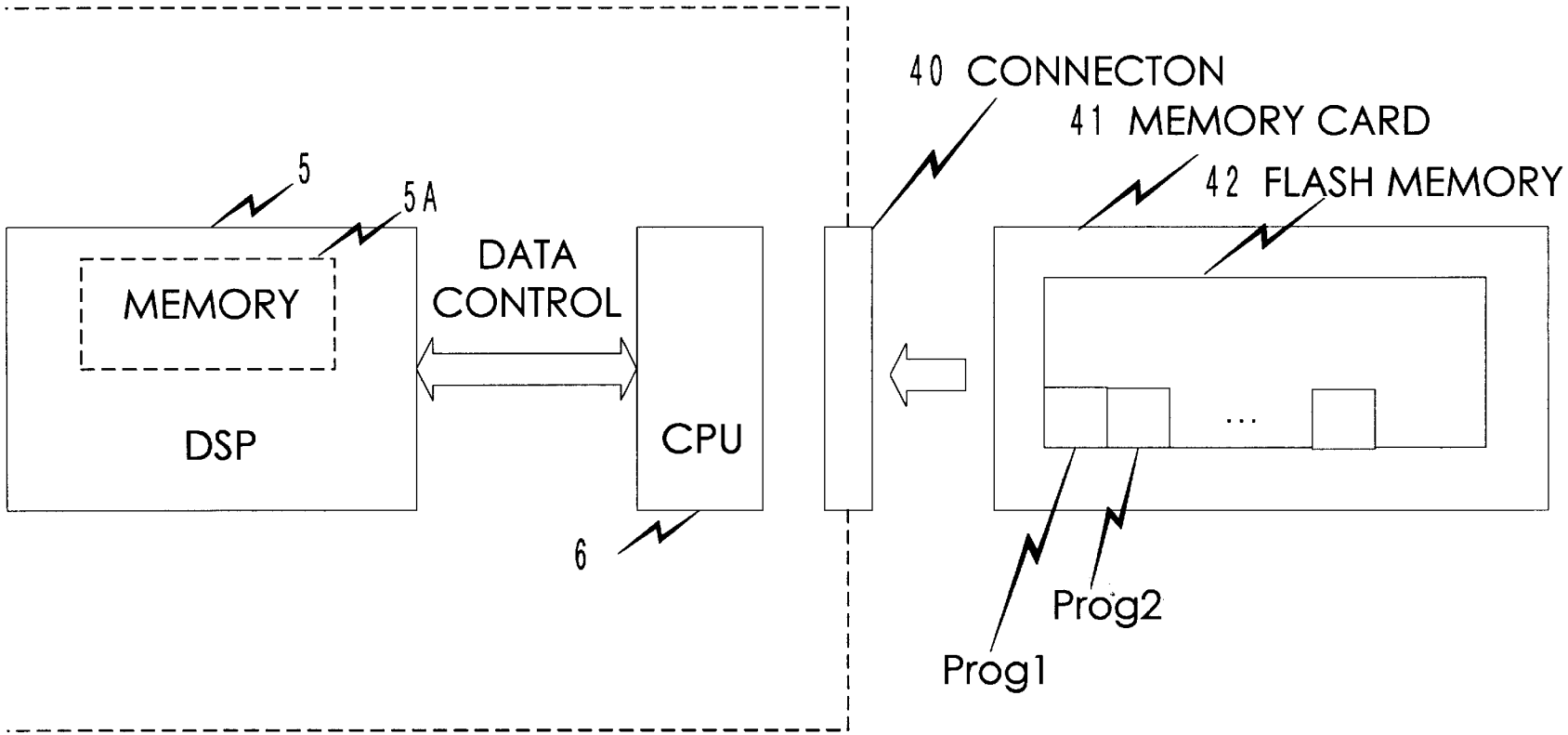
FIG. 10 is a block diagram which shows a digital signal processor, a connector, and a memory card to be coupled to the connector in a voice data processing device in a third embodiment of the present invention.

FIG. 10 is a block diagram which shows a digital signal processor, a connector 40, and a memory card 41 connected to the connector in a voice data processing device in the third embodiment of the present invention.

The same elements as those of the first embodiment are given the same reference numerals and their details are omitted.

The voice data processing device of this third embodiment has substantially the same structure as those of the first and second embodiments, but is characterized in that a removable memory card 41 is used as the storage medium 10 in the first and second embodiments, and a connector 40 for coupling the memory card 41 is the receiver for receiving the program rewrite signal.

The connection of the memory card will now be described.

As described above, in the voice data processing device of this embodiment, the storage medium for storing voice data is the removable memory card 41.

The memory card 41 comprises an IC memory such as a flash memory 42 or the like. A plurality of DSP programs (Prog1, Prog2, . . .) are prestored in the IC memory. A switch (not shown) provided in the voice data processing device is changed over to select one of the DSP programs in the flash memory 42. The selected program(s) is transmitted to a control circuit 6 through the connection 40.

The control circuit 6 controls a digital signal processor 5 to rewrite the DSP program into a program memory 5A (flash memory) in the digital signal processor 5.

According to the third embodiment, the application of the voice data processing device can be determined by selecting one of the programs stored in the memory card, and the program can be changed without transmitting data by a program writing device and a two-core cable.

What is claimed is:

1. A voice data processing device for at least one of recording and reproducing a voice, the device comprising:

a housing;

a digital signal processor arranged within the housing;

a rewritable program memory, incorporated in the digital signal processor, for storing a program and being arranged within the housing; and a connector including:

an arrangement for receiving a program rewrite signal to rewrite the program without exposing the program memory to an environment external to the housing of the device, and an arrangement for performing at least one of a transmitting operation and a receiving operation with respect to a signal having an audio content.

2. The device of claim 1, wherein the connector is a connector for a memory card to be removably attached to the device, and the program is rewritten by transmitting a program prestored in the memory card to the rewritable program memory integrated with the digital signal processor.

3. The device of claim 1, wherein the device comprises a battery chamber, and the receiver is provided within the battery chamber.

4. The device of claim 1, wherein the connector is an output terminal provided in the device.

5. The device of claim 1, wherein the connector is an input terminal provided in the device.

6. The device of claim 5, wherein the input terminal is an input terminal for an external power supply.

7. The device of claim 1, wherein the connector is a connector for a memory card to be removably attached to the device, and the program can be rewritten through the connector into the rewritable program memory.

8. The device of claim 1, wherein the program is stored in a memory card to be removably attached to the device and can be rewritten from the memory card into the rewritable program memory.

9. The device of claim 1, wherein the rewritable program memory is externally coupled to the digital signal processor.

10. The device of claim 1, wherein the rewritable program memory is included within the digital signal processor.

11. The device of claim 1, further comprising:

an operation portion including at least one input device; and a data storage medium for storing a plurality of data files, wherein an activation of the at least one input device associates a predetermined mark with at least one of the plurality of data files.

12. The device of claim 11, wherein the predetermined mark is indicative of an end of an associated data file.

13. The device of claim 11, wherein the predetermined mark is indicative of a predetermined relationship between an associated data file and at least another file of the plurality of data files.

14. The device of claim 1, wherein the connector is a connector for achieving a connection with a general purpose computer, and wherein the program is rewritten by transmitting another program prestored in the general purpose computer to the rewritable program memory.

15. The device of claim 1, wherein:

the rewritten program corresponds to a voice coding application, and the voice coding application of the rewritten program is different from a voice coding application of a previously written program.

16. The device of claim 1, further comprising:

a control device including at least a first control circuit for controlling the digital signal processor and a second control circuit for controlling the first control circuit.

17. The device of claim 16, wherein the first control circuit controls the program rewrite of the rewritable program memory.

18. The device of claim 16, wherein the control device includes a power control circuit for controlling a delivery of an operating voltage to the digital signal processor.

19. The device of claim 18, further comprising:

a first switch through which the operating voltage is coupled to the power control circuit; and a second switch through which the operating voltage is coupled from the power control circuit to the digital signal processor.

20. The device of claim 1, wherein the connector is connectable with a program rewrite device that stores a plurality of programs, and further comprising:

a switch for selecting at least one of the plurality of programs to be written to the rewritable program memory.

21. A voice data processing device for at least one of recording and reproducing a voice, the device comprising:

a housing;

a digital signal processor arranged within the housing;

a rewritable program memory, integrated with the digital signal processor, for storing a program and being arranged within the housing; and a receiver for receiving a program rewrite signal to rewrite the program without exposing the program memory to an environment external to the housing of the device, wherein the receiver is a connector provided in the device, and the connector also performs a function other than rewriting the program, wherein the connector is an output terminal provided in the device, and wherein the output terminal is an earphone jack.

22. A voice data processing device for at least one of recording and reproducing a voice, the device comprising:

a housing;

a digital signal processor arranged within the housing;

a rewritable program memory, integrated with the digital signal processor, for storing a program and being arranged within the housing; and a receiver for receiving a program rewrite signal to rewrite the program without exposing the program memory to an environment external to the housing of the device, wherein the receiver is a connector provided in the device, and the connector also performs a function other than rewriting the program, wherein the connector is an output terminal provided in the device, and wherein the output terminal is an output terminal for an external speaker.

23. A voice data processing device for at least one of recording and reproducing a voice, the device comprising:

a housing;

a digital signal processor arranged within the housing;

a rewritable program memory, integrated with the digital signal processor, for storing a program and being arranged within the housing; and a receiver for receiving a program rewrite signal to rewrite the program without exposing the program memory to an environment external to the housing of the device, wherein the receiver is a connector provided in the device, and the connector also performs a function other than rewriting the program, wherein the connector is an input terminal provided in the device, and wherein the input terminal is an input terminal for an external microphone.

24. A method of programming a rewritable program memory of a voice data processing device, comprising the steps of:

(a) transmitting a program writing command to the rewritable program memory;

(b) receiving a program through a connector of the voice data processing device from a program rewriting device;

(c) writing the program into the rewritable program memory; and (d) causing the connector to perform one of a receiving operation and a transmitting operation with respect to a signal having an audio content.

25. The method of claim 17 wherein the step of writing the program into the rewritable program memory comprises the step of transferring the program from the temporary storage medium to the rewritable program memory.

26. The method of claim 17 wherein the step of storing the received program in the temporary storage medium comprises the steps of:

(i) receiving a signal representing a size of the program;

(ii) initializing a current value of a counter to a start value indicative of the size of the program;

(iii) receiving one of a plurality of data segments of the program;

(iv) decrementing the current value by a predetermined amount;

(v) storing the received data segment of the program in the temporary storage medium; and (vi) repeating steps (iii)–(vi) until the current value of the counter equals an end value.

27. The method of claim 24, wherein:

the written program corresponds to a voice coding application, and the voice coding application of the written program is different from a voice coding application of a previously written program.

28. The method of claim 24, further comprising the step of:

before the program is received from the program rewrite device, selecting the program from a plurality of programs stored in the program rewrite device.

29. The method of claim 24, wherein the step of receiving the program comprises the step of storing the received program in a temporary data storage medium.

* * * * *